United States Patent [19]

Tisbo et al.

[11] Patent Number: 4,531,645

[45] Date of Patent: Jul. 30, 1985

[54] PORTABLE STORAGE CONSOLE

[75] Inventors: Thomas A. Tisbo, Barrington; George L. Garcia, Chicago, both of Ill.

[73] Assignee: Suncast Corporation, Batavia, Ill.

[21] Appl. No.: 511,488

[22] Filed: Jul. 7, 1983

[51] Int. Cl.[3] ..... A47F 5/02

[52] U.S. Cl. ..... 211/131; 211/70; 211/163; 211/70.6; 312/DIG. 33; 312/125; 312/126; 312/252

[58] Field of Search ..... 108/103; 211/70, 70.6, 211/163, 144, 131; 312/125, 126, DIG. 33, 135, 252, 305, 350, 321; 248/131, 425

[56] References Cited

U.S. PATENT DOCUMENTS 3,850,487 11/1974 Batchelor ..... 312/252
3,858,529 1/1975 Salladay ..... 211/163 X
4,480,755 11/1984 Cartwright ..... 211/70.6

FOREIGN PATENT DOCUMENTS 2257247 8/1975 France ..... 211/163

*Primary Examiner*—Robert W. Gibson, Jr.
*Attorney, Agent, or Firm*—Anthony S. Zummer

[57] ABSTRACT

The present invention relates to an improved portable storage console for holding a plurality of a variety of articles. The console includes a base. A cabinet is rotatably secured to the base for rotating about an axis which is substantially perpendicular to the base. The cabinet is adapted for storing articles within the cabinet and for holding articles on the exterior surface of the cabinet. The cabinet has a plurality of trays releasably secured in the interior of the cabinet. Each of the trays extends the full width and full depth of the interior of the cabinet. The cabinet has a plurality of rollers mounted on its lower surface. The rollers rotatably engage the base. Each of the rollers is rotatable about a roller axis which intersects the axis of rotation of the cabinet.

27 Claims, 19 Drawing Figures

FIG. 1
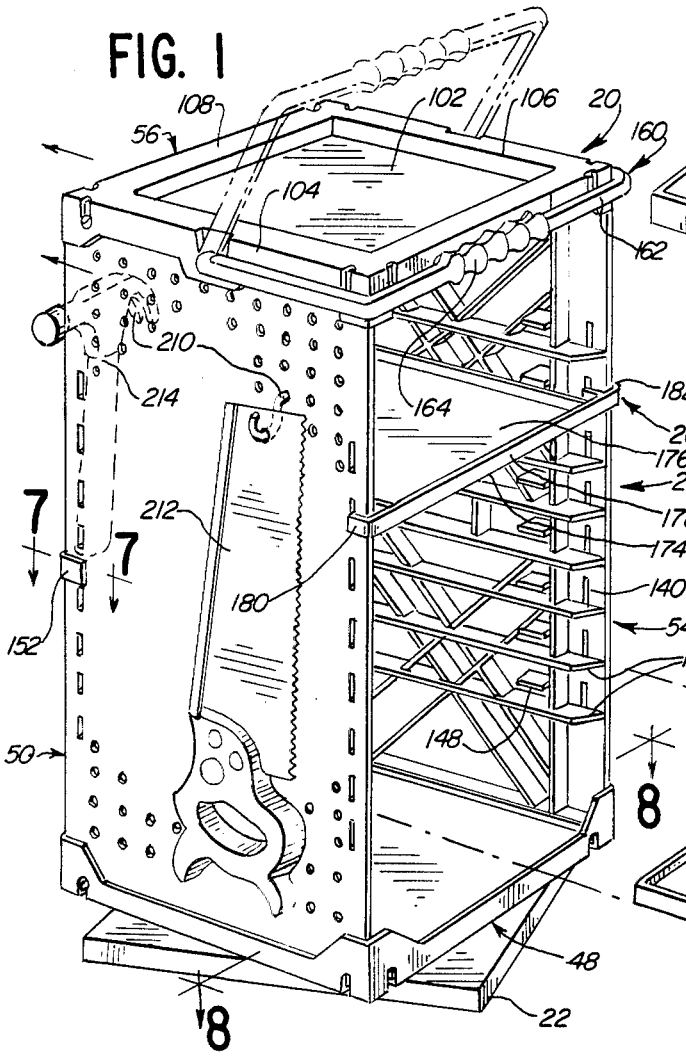
FIG. 2
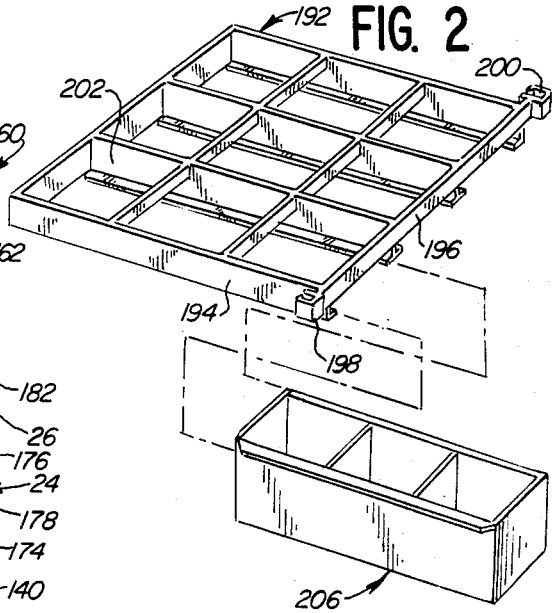
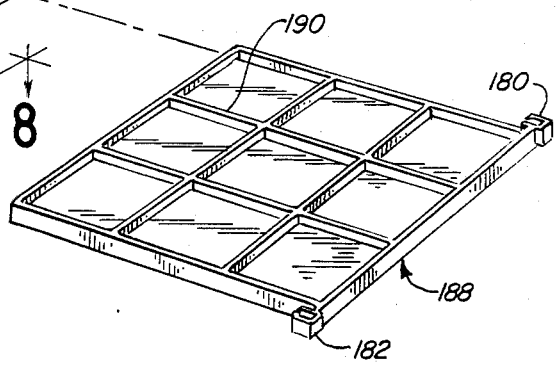
FIG. 3
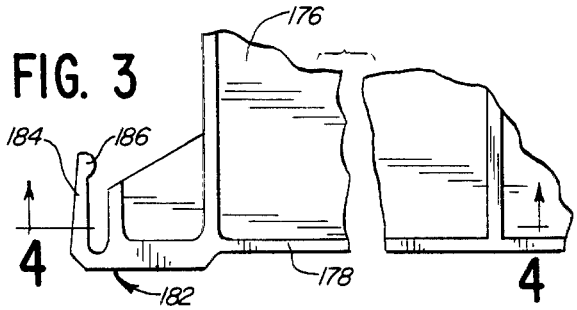
FIG. 5
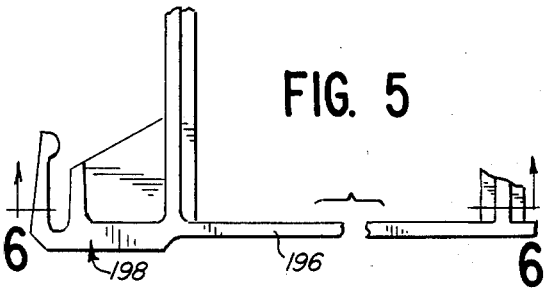
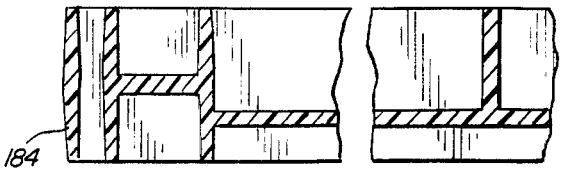
FIG. 4
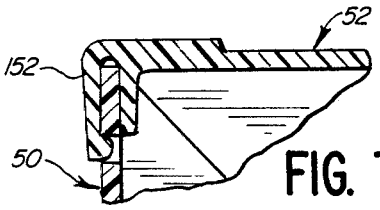
FIG. 7
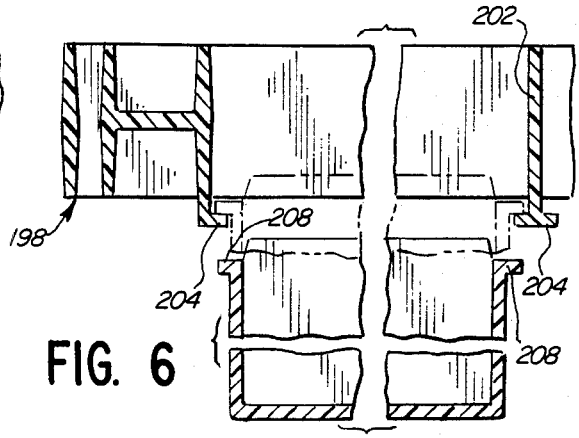
FIG. 6

FIG. 8
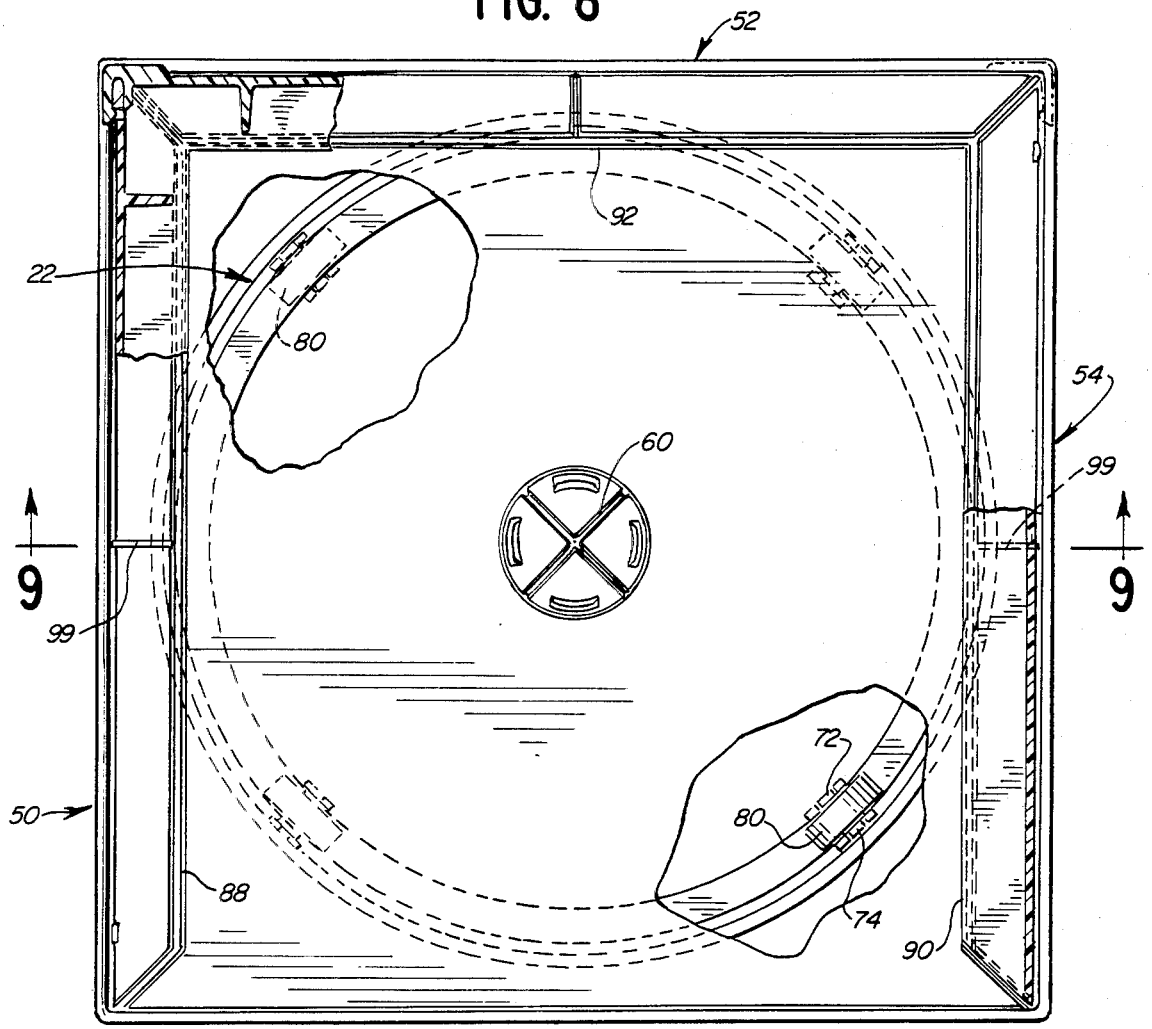
FIG. 9
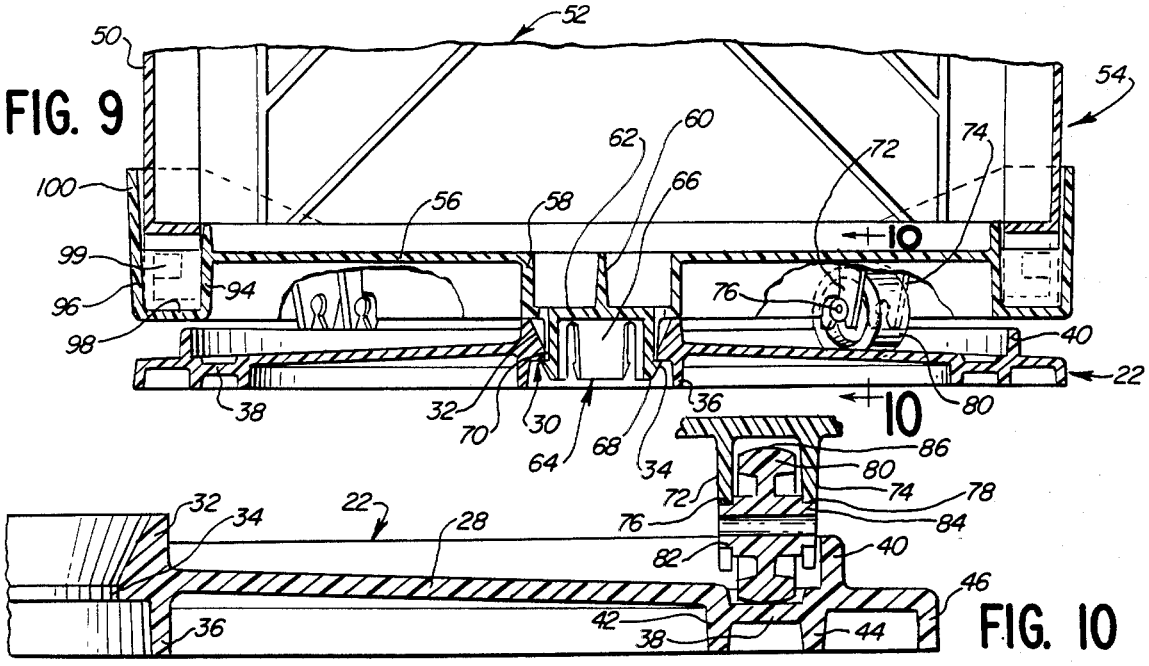
FIG. 10

FIG. 11
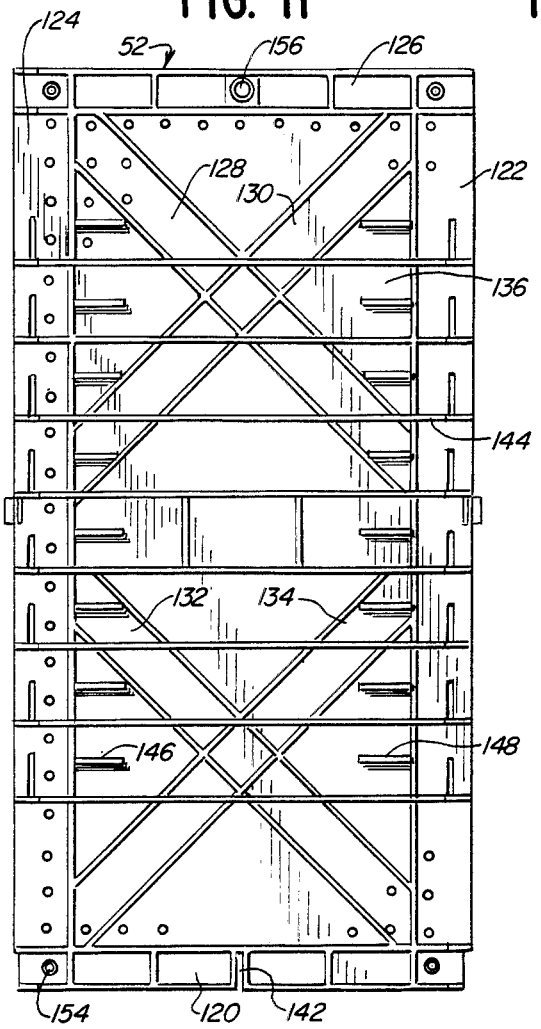
FIG. 12
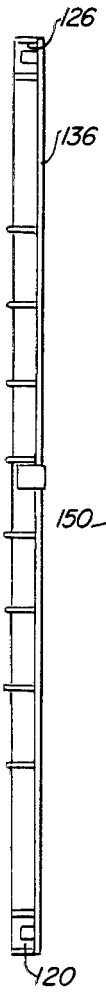
FIG. 13
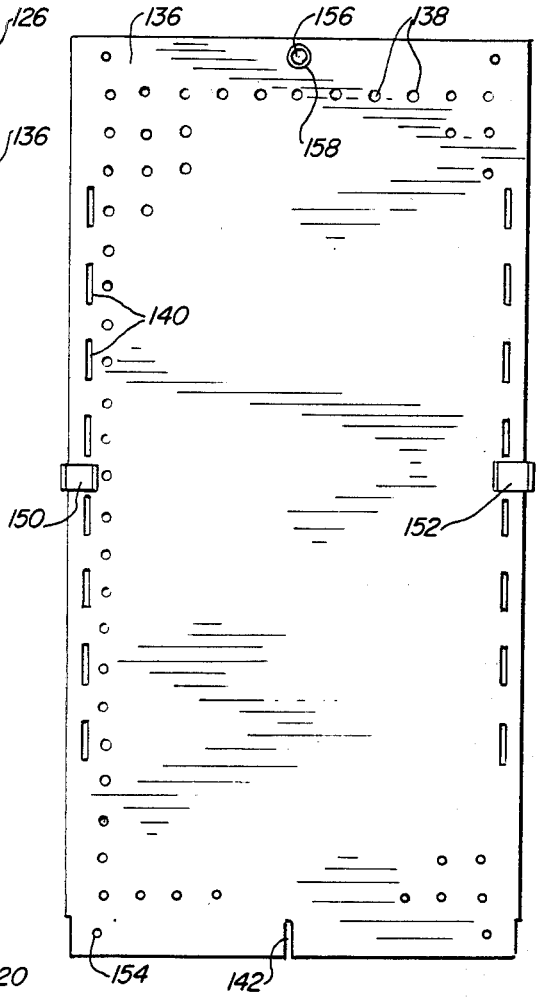
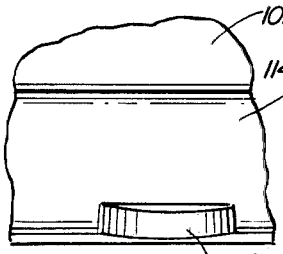
FIG. 14
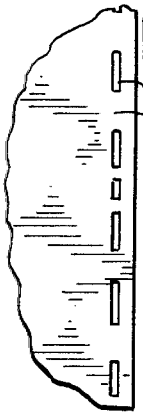
FIG. 19
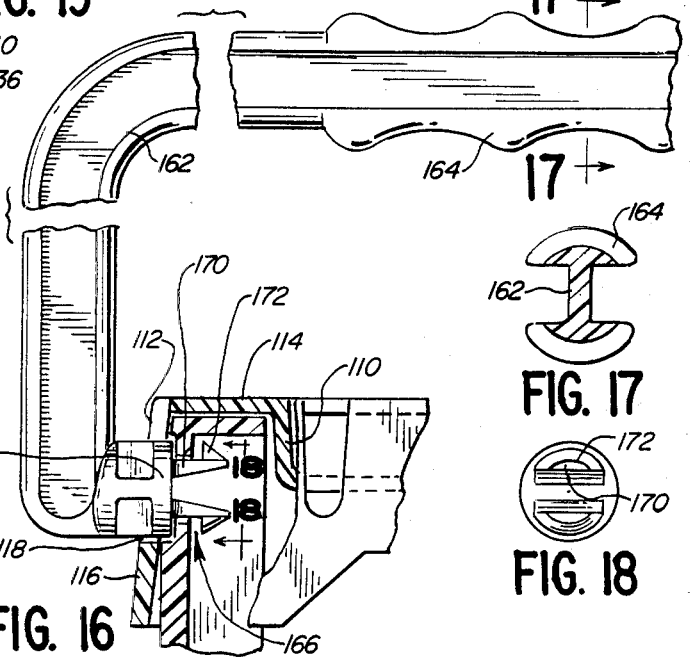
FIG. 16
FIG. 17
FIG. 18
FIG. 15
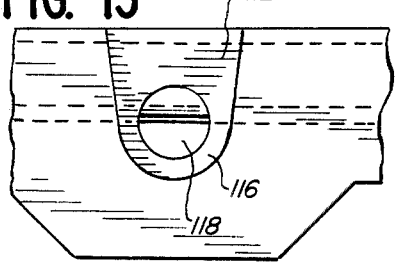

PORTABLE STORAGE CONSOLE

BACKGROUND OF THE INVENTION

For many individuals, such as, hobbyists, it is desirable to provide a portable storage console in which an individual may store tools, and other articles. It is further desirable that the console be easily transported from one location to another and provide a convenient apparatus for presenting devices as required. It is recognized that a storage console which is rotatable on a base may provide a suitable means for holding articles within a cabinet and on a cabinet, so that the cabinet may be rotated in order to present a particular array of articles, such as, tools.

Cabinets which include shelves and which cabinets are rotatable are well known. A typical cabinet of this type is taught in U.S. Pat. No. 391,630, issued Oct. 23, 1888, to A. McNeill, entitled, "Show Case". Another rotatable cabinet is taught in U.S. Pat. No. 99,606, issued Feb. 8, 1870, to A. Sly, and S. Ford, entitled, "Provision Safe". The McNeill show case and the Sly et al provision safe do not teach a device which is readily portable. A portable device is taught in U.S. Pat. No. 3,850,487, issued Nov. 26, 1974, to Batchelor, entitled, "Sewing Caddy". The Batchelor device, like many other devices illustrated in U.S. Pat. No. 1,029,709, to Norrlander, issued June 18, 1912, entitled, "Grocer's Cabinet" and U.S. Pat. No. 2,354,835, issued Aug. 1, 1944, to Rosenberg, entitled, "Cabinet" has a central shaft which precludes the utilization of the interior portion of the device by a continuous tray or shelf. Accordingly, prior to the applicants' invention, the state of the art was one in which the construction of a rotary cabinet was either a cabinet which stayed in place, and had no center position, or one which was portable but contained a central shaft. The typical problem being that the interconnection between the base and the cabinet required a center shaft so that the base could move with the cabinet.

SUMMARY OF THE INVENTION

The present invention relates to an improved construction for a portable storage console. The storage console includes a base which is adapted for mounting on a generally flat surface. A cabinet is rotatably secured to the base for rotating about an axis susbstantially perpendicular to the base. A plurality of trays is mounted in the cabinet. Each of the trays extends the full width and depth of the interior of the cabinet. Each tray is releasably locked to the cabinet to hold the tray in the cabinet until it is selectively released from the cabinet. The cabinet has a pluarlity of rollers mounted on the lower surface of the cabinet. The rollers are rotatably engagable with the base. Each of the rollers is rotatable about an axis intersecting the axis of rotation of the cabinet.

BRIEF DESCRIPTION OF THE DRAWINGS

FIG. 1 is a perspective view of a portable storage console embodying the herein disclosed invention with a tray shown removed from a cabinet of the console;

FIG. 2 is a perspective view of another form of tray which may be utilized in the portable storage console showing a portion of the tray removed from a frame;

FIG. 3 is an enlarged fragmentary plan view of a portion of one corner of the tray shown in FIG. 1;

FIG. 4 is a cross sectional view taken on Line 4—4 of FIG. 3;

FIG. 5 is an enlarged fragmentary plan view of a portion of the tray shown in FIG. 2;

FIG. 6 is a cross sectional view taken on Line 6—6 of FIG. 5 showing a portion of a container spaced away from a frame of the tray;

FIG. 7 is an enlarged fragmentary cross sectional view taken on Line 7—7 of FIG. 1;

FIG. 8 is an enlarged cross sectional view with portions broken-away showing a portion of a bottom of a cabinet and showing the interrelationship of rollers with a base supporting the cabinet;

FIG. 9 is a cross sectional view taken on Line 9—9 of FIG. 8;

FIG. 10 is an enlarged fragmentary cross sectional view taken on Line 10—10 of FIG. 9 showing the interrelationship of a roller with a portion of the base and a track in the base;

FIG. 11 is a side elevational view of a panel which constitutes a portion of the cabinet of FIG. 1;

FIG. 12 is an end view of the panel in FIG. 11;

FIG. 13 is a side view of the opposite side of the panel of FIG. 11;

FIG. 14 is an enlarged fragmentary top view of a portion of a top of the cabinet shown in FIG. 1;

FIG. 15 is an enlarged fragmentary side view of the portion of the top shown in FIG. 14;

FIG. 16 is an enlarged fragmentary cross sectional view showing the interconnection of a handle with the top and a panel;

FIG. 17 is a cross sectional view taken on Line 17—17 of FIG. 16;

FIG. 18 is an end elevational view taken on Line 18—18 of FIG. 16; and FIG. 19 is an enlarged fragmentary view of a portion of the panel of FIG. 11 showing a plurality of lock slots.

DESCRIPTION OF THE PREFERRED EMBODIMENT

Referring now to the drawings, and especially to FIG. 1, a portable storage console embodying the herein disclosed invention is generally indicated by numeral 20. Portable storage console 20 generally includes; a base 22, a cabinet 24 rotatably secured to the base, and a plurality of trays 26 removeably secured in the cabinet.

Referring now to FIGS. 8, 9, and 10, it may be seen that base 22 is a unitary molded plastic part, molded of a suitable material, such as, high impact polypropylene, though any other suitable moldable plastic material may be used. The base construction includes a floor 28 with a journal receptacle 30 formed in the center of the floor. The journal receptacle includes a guide wall 32 which has an inwardly tapered surface and a cylindrical lock wall 34 which has its axis in line with the axis of the guide wall. An annular journal support 36 is formed integral with the lower surface of the floor to provide a support for the cabinet.

A circular track 38 is formed in floor 28. The circular track has its center coincidental with the axis of the lock wall. A track wall 40 is formed integral with the upper surface of the floor along the outer periphery of track 38 so that the track wall is circular and has its center coincidental with the center of track 38. An inner track support 42 is formed integral with the lower surface of floor 28 and defines a circle which has its center coincidental with track 38. An outer track support 44 is formed integral with the lower surface of floor 28 and is also circular having its center coincidental with the center of the track. An outer support edge 46 is formed integral with the outer periphery of the floor. The journal support, inner and outer track supports, and the outer support edge each has its respective lowermost edge on the same plane so that the base may rest on a flat surface.

Cabinet 24 generally includes a molded integral bottom 48 which is molded of a high impact polypropylene, though any other suitable moldable plastic material may be used. Three substantially identical panels, 50, 52 and 54 are secured to the bottom. Panels 50, 52, and 54 are molded of polypropylene, though any suitable moldable plastic material may be used. A molded integral top 56 made of the same material as bottom 48 is secured to the upper edges of the panels. Bottom 48 includes a generally square platform 56 which has a journal boss 58 formed thereon with a cross reinforcement wall 60 inside the boss. The journal boss includes a circular head 62 which has its outer periphery formed integral with boss 58. The head has its upper side formed integral with the cross reinforcement wall 60. A journal 64 is formed integral with head 62. Journal 64 generally consists of four identical cantilever fingers 66. Each of the fingers has its upper edge formed integral with head 62. Each finger 66 includes a bevel face 68 which is engagable with guide wall 32 of the journal receptacle. Each finger includes locking edge 70 which engages the lock wall of the journal receptacle to secure the journal to the journal receptacle.

The bottom includes four pairs of roll ears 72 and 74 which are formed integral with the side of platform 56 adjacent to the base. The roll ears 72 and 74 contain apertures 76 and 78, respectively. A roller 80 is rotatably mounted between each pair of ears. Each roller 80 includes axles 82 and 84 which are rotatably mounted in apertures 76 and 78, respectively. Each roller 80 has a rolling surface 86 on its outer periphery which rolling surface is in engagement with track 38. The rollers allow the bottom to rotate freely about the journal receptacle, thereby allowing the cabinet to rotate on an axis which is perpendicular to the base and is coincidental with the axis of journal 64, the axis of the guide wall, and the axis of the lock wall. The track wall aids in retaining the rollers in the track.

Bottom 48 includes a panel groove 88 along one edge and a parallel panel groove 90 along the opposite edge. A third panel groove 92 is formed along a third edge and intersects the ends of grooves 88 and 90. Each of the grooves includes an inner wall 94 and an outer wall 96 with a strip 98 connecting the walls. A panel lock ear 99 is formed in the middle of each of the grooves. A corner wall 100 is formed integral with each of the outer walls 96 to provide additional support at the corners.

Top 56 includes a stage 102 with a pair of parallel panel receivers 104 and 106 in opposite sides and a third panel receiver 108 connecting the ends of the two parallel panel receivers. Each of the receivers includes; a receiver inner wall 110, a receiver outer wall 112, and a connector plate 114. A handle lug 116 is formed integral with the outer wall, and a handle aperture 118 is formed in the handle lug.

Referring now to FIGS. 11, 12, and 13, the construction of panel 52 is shown therein. Panel 52 includes a bottom beam 120, with a pair of columns 122 and 124 formed integral with opposite ends of the bottom beam. A top beam 126 has its opposite ends formed integral with the tops of columns 122 and 124. A pair of upper cross stays 128 and 130 is formed integral with the columns, and a pair of lower cross stays 132 and 134 is also formed integral with the columns. An outer plate 136 is formed integral with the beams, columns, and cross stays. The outer plate includes a plurality of apertures 138 regularly spaced on the outer plate. The plate has a plurality of lock slots 140 formed therein. The panel includes a mounting slot 142 on its lower edge for receiving a panel lock ear in the bottom of a respective groove.

Panel 52 includes a plurality of identical tray ledges 144 which are parallel to each other, and each tray ledge is perpendicular to the outer plate. The tray ledges are formed integral with the columns and the outer plate. A pair of rails 146 and 148 is positioned above each of the tray ledges. The tray rails are parallel to their respective tray ledges and are formed integral with the outer plate of the panel. A pair of clips 150 and 152 is formed integral with the outer panel. Each of the clips 150 and 152 has a portion substantially perpendicular to the outer panel. The outer panel has four fastening apertures 154. Each fastening aperture is positioned in one corner of the panel. A handle mount 156 is formed through the outer plate and into the upper beam. A recess 158 is formed in the outer plate concentric with the handle mount, as may be best seen in FIG. 16.

Panels 50 and 54 are identical in construction to panel 52, except that panels 50 and 54 do not have the clips 150 and 152, since clips 150 and 152 engage panels 50 and 54 to lock the panels together.

Handle 160 is pivotally mounted on top 56. The handle is molded polypropylene, though any other moldable suitable plastic material may be used. The handle includes a bail 162 with an enlarged gripping portion 164 formed integral therewith. A lock 166 is formed integral with each end of the bail. A bail face 168 is formed integral with each end of the bail. A plurality of resilient locking teeth 170 is formed integral with the bail face. Each tooth 170 includes a dog 172 which extends outward from the tooth. As may be seen in FIG. 16, the teeth are forced into aperture 156 so that the resilence of the teeth allows the dogs to enter the aperture. Once the dogs pass the wall, the resilence of the teeth places the dogs in engagement with the interior surface of the panel to lock the bail to the panel. The bail face rides in recess 158.

A plurality of trays 26 is mounted in the cabinet. Each tray 26 includes a square frame 174 with a table 176 formed integral with the frame. The frame includes a front bar 178. A pair of tongues 180 and 182 is formed integral with opposed ends of the front bar. Each tongue includes a claw 184 with a keeper 186 formed integral with its respective claw. The claws extend inward and are engagable with the lock slots in the panel.

Looking now to FIG. 1, a second tray 188 is shown therein. Tray 188 is identical in construction to tray 26, but tray 188 is shown with the table, wherein the side of the table shown in the top includes a plurality of dividers 190 to form seperate areas. Thus, the tray may readily be used with or without dividers by the simple selection of the side of the table which is to be positioned on the upper side.

Looking now to FIG. 2, a second form of tray 192 is shown therein. Tray 192 includes a frame 194 with a front bar 196 constituting a portion of the frame. Tray 192 includes tongues 198 and 200 which are identical to tongues 180 and 182 of tray 26. Tray 192 includes a plurality of elongated supports 202 which have support ledges 204 formed thereon. Tray 192 includes a plurality of elongated containers 206 which have support lips 208 formed on opposed sides for mounting on ledges 202, thus tray 192 may carry several containers 206, for holding a variety of items.

Cabinet 24 has the lower edge of panels 50, 52, and 54 mounted in panel grooves 88, 92, and 90 of bottom 48. Conventional fasteners positioned in the two lower fastener apertures 154 of each of the panels secure the lower edge of the panels to the bottom. Each panel 50, 52, and 54 has its upper edge mounted in panel receivers 104, 108, and 106, respectively. Conventional fasteners are mounted in the two upper fastener apertures 154 of each of the panels to secure the panels to the top.

Trays 26, 188, and 192 are selectively positioned on each of a pair of tray ledges. The upper edge of the tray engages the tray rails so that the trays will be held securely in the cabinet. Each of the tray claws 184 extends around the edge of the respective outer panel and keepers 186 fit into respective lock slots 140 to hold the trays in the cabinet. It may be appreciated that the trays may be readily removed from the cabinet by removing the keepers from the lock slots and sliding the tray out of the cabinet. The cabinet also serves to store items on the exterior of the cabinet by utilizing conventional mounting hooks 210 which are positioned in selected mounting apertures 138 of the outer plate. In FIG. 1, a conventional saw 212 is shown mounted on one of the hooks and a conventional hammer 214 is shown mounted on another hook.

The instant portable storage console may be placed in a convenient storage area, such as, a closet. When it is necessary to utilize the apparatus, the storage console may be removed from the closet and placed on a work surface, such as, a table or a counter. It may be readily appreciated that trays bearing any selected articles, such as; screws, nails, washers, or other devices may be placed on the trays. Tools also may be loaded on the tray. In the event that it is necessary to utilize other tools which are stored on the exterior of the cabinet, the cabinet may be conveniently rotated on its base to present the required apparatus.

Although a specific disclosure of the storage console has been described in terms of an apparatus for storing tools, it may be appreciated that it has a wide range of usage, such as, providing a convenient device for use by a hobbyist, such as, a model maker or a seamstress. It is to be expressly understood that although a specific embodiment of the instant invention has been shown in accompanying drawings, and described in detail above, those skilled in the art may make various modifications and changes without departing from the spirit and scope of the present invention. It is to be expressly understood that the instant invention is limited only by the appended claims.

What is claimed is:

1. A portable storage console for holding a plurality of articles, comprising, in combination; a base, a cabinet rotatably secured to the base for rotating about an axis substantially perpendicular to the base, a plurality of rollers positioned between the cabinet and the base rotatably supporting the cabinet on the base, and a plurality of trays removably mounted in the cabinet, each of said trays extending substantially the entire interior width and depth of the cabinet, each of said trays being releasably locked to the cabinet in an attitude substantially perpendicular to the axis of rotation of the cabinet.

2. A portable storage console for holding a plurality of articles as defined in claim 1, including a circular track formed integral with the base, said circular track having its center substantially coincidental with the axis of rotation of the cabinet, said rollers being positioned on the track.

3. A portable storage console for holding a plurality of articles as defined in claim 1, wherein said base includes a journal receptacle, and said cabinet includes a journal extending downwardly therefrom being rotatable in the journal receptacle, said journal having a lock cooperative with the journal receptacle for rotatably securing the journal in the journal receptacle to secure rotatably the cabinet to the base.

4. A portable storage console for holding a plurality of articles as defined in claim 1, wherein said cabinet includes a pair of opposed panels forming opposed sides of the cabinet, each of said panels having a plurality of tray ledges positioned opposite like tray ledges on the other panel for slideably receiving a tray on each pair of opposed tray ledges, and each of said panels having a plurality of mounting apertures for receiving hooks for holding articles on the panels.

5. A portable storage console for holding a plurality of articles as defined in claim 1, wherein one of said trays includes a table extending from one side of the cabinet to the other, and each of said trays having a pair of tongues on opposed sides for engagement with the cabinet for releasably holding the tray in the cabinet.

6. A portable storage console for holding a plurality of articles as defined in claim 1, wherein said cabinet includes; a bottom having four sides, said bottom having panel grooves formed in each of three sides, a panel mounted in each of the panel grooves, and a top having a panel receiver on each of three sides receiving each of the panels.

7. A portable storage console for holding a plurality of articles as defined in claim 1, wherein said cabinet has a plurality of lock slots adjacent to two parallel edges; and each of said trays having a frame, a pair of tongues formed integral with each of the frames, each of said tongues having a claw, and each claw having a keeper formed integral therewith, each of said keepers being positionable in a lock slot for releasably holding the respective tray in the cabinet.

8. A portable storage console for holding a plurality of articles as defined in claim 1, wherein one of said trays includes, a table extending from one side of the cabinet to the other, said table being substantially flat with one side being a continuous substantially flat surface and the opposite side having a plurality of dividers, whereby said tray may be used selectively either with a plain continuous surface or a divided surface by selecting which side of the tray is the upper side.

9. A portable storage console for holding a plurality of articles as defined in claim 1, wherein said base includes; a circular track on the side adjacent to the cabinet, said circular track having its center substantially coincidental with the axis of rotation of the cabinet, and a track wall formed integral with the side of the base adjacent to the cabinet and being positioned adjacent to the outer periphery of the track, said rollers being rotatably mounted in the track.

10. A portable storage console for holding a plurality of articles as defined in claim 1, wherein said base includes a journal receptacle, and said cabinet includes a journal formed integral with the lowermost portion of the cabinet, said journal being rotatably mounted in the journal receptacle, said journal including a plurality of cantilever fingers, and each of said fingers including a locking edge engagable with the journal receptacle for rotatably securing the journal in the journal receptacle.

11. A portable storage console for holding a plurality of articles as defined in claim 1, wherein said base includes a journal receptacle having its center coincidental with the axis of rotation of the cabinet, a circular track formed integral with the base having its center substantially coincidental with the center of the journal receptacle, said rollers being rotatable positioned in the track, and said cabinet includes a journal extending downward therefrom, said journal being rotatable in the journal receptacle, said journal having a lock cooperative with the journal receptacle for rotatably securing the journal in the journal receptacle to secure rotatably the cabinet to the base.

12. A portable storage console for holding a plurality of articles as defined in claim 1, wherein said base includes a journal receptacle having its center substantially coincidental with the axis of rotation of the cabinet, and said cabinet includes a journal formed integral with the lowermost portion of the cabinet, said journal being rotatably mounted in the journal receptacle, said journal including a plurality of cantilever fingers, each of said fingers including a locking edge engagable with the journal receptacle and rotatably securing the journal in the journal receptacle.

13. A portable storage console for holding a plurality of articles as defined in claim 1, wherein said base includes a journal receptacle, said journal receptacle having a guide wall and a lock wall formed integral with the guide wall, said guide wall being cylindrical and having its center substantially coincidental with the center of the axis of rotation of the cabinet, and said cabinet includes a journal formed integral with the lowermost portion of the cabinet, said journal being rotatably mounted in the lock wall of the journal receptacle, said journal including a plurality of cantilever fingers, each of said fingers including a locking edge engagable with the lock wall of the journal receptacle for rotatably securing the journal in the journal receptacle.

14. A portable storage console for holding a plurality of articles as defined in claim 1, including a circular track formed integral with the base, said circular track having its center substantially coincidental with the axis of rotation of the cabinet, said rollers being positioned on the track, and said cabinet including, a bottom having four sides, said bottom having panel grooves formed in each of three sides, a panel mounted in each of the panel grooves, and a top having a panel receiver on each of three side receiving each of the panels.

15. A portable storage console for holding a plurality of articles as defined in claim 1, wherein said base includes a journal receptacle, said cabinet includes a bottom having four sides, said bottom having panel grooves formed in each of the three sides, a panel mounted in each of the panel grooves, a top having a panel receiver for each of three sides receiving each of the three panels, a journal formed integral with the bottom of the cabinet, said journal extending downward from the bottom and being rotatable in the journal receptacle, and said journal having a lock cooperative with the journal receptacle for rotatably securing the journal in the journal receptacle to secure rotatably the cabinet in the base.

16. A portable storage console for holding a plurality of articles as defined in claim 1, wherein said cabinet includes a pair of opposed panels forming opposite sides of the cabinet, each of said panels having a plurality of tray ledges positioned opposite like tray ledges on the other panel for slideably receiving a tray in each pair of opposed tray ledges, and each of said panels having a plurality of mounting apertures for receiving hooks for holding articles on the panels; one of said trays including a table extending from one side of the cabinet to the other, and each of said trays having a pair of tongues on opposed sides for engagement with the cabinet for releasably holding the respective tray in the cabinet.

17. A portable storage console for holding a plurality of articles as defincd in claim 1, wherein said cabinet includes a bottom having four sides, said bottom having panel grooves formed in each of three sides, a panel mounted in each of the panel grooves with two of the panels being opposed, and a top having a panel receiver on each of three sides receiving each of the panels, each of said opposed panels having a plurality of tray ledges positioned opposite like tray ledges on the other opposed panel for slideably receiving a tray on each pair of opposed tray ledges, and each of said panels having a plurality of mounting apertures for receiving hooks for holding articles on the panels.

18. A portable storage console for holding a plurality of articles as defined in claim 1, wherein said base includes a journal receptacle, said journal receptacle having its center susbtantially coincidental with the axis of rotation of the cabinet, a circular track formed integral with the base on the side adjacent to the cabinet, said circular track having its center coincidental with the center of the journal receptacle, a track wall formed integral with the side of the base adjacent to the cabinet and being positioned adjacent to the outer periphery of the track, said rollers being rotatably mounted in the track, said cabinet including a journal formed integral with the lowermost portion of the cabinet, said journal being rotatably mounted in the journal receptacle, said journal including a plurality of cantilever fingers, and each of said fingers including a locking edge engagable with the journal receptacle for rotatably securing the journal in the journal receptacle.

19. A portable storage console for holding a plurality of articles as defined in claim 1, wherein said base includes a journal receptacle having its center substantially coincidental with the axis of rotation of the cabinet, said journal receptacle includes a guide wall adjacent to the cabinet and a lock wall formed integral with the guide wall, said lock wall being cylindrical and having its center coincidental with the center of the journal receptacle, a circular track formed integral with the base on the side adjacent to the cabinet, said circular track having its center substantially coincidental with the center of the journal receptacle, a track wall formed integral with the side of the base adjacent to the cabinet and being positioned adjacent to the outer periphery of the track, said rollers being rotatably mounted on the track, said cabinet includes a journal formed integral with the lowermost portion of the cabinet, said journal being rotatably mounted in the journal receptacle, said journal including a plurality of cantilever fingers rotatably mounted within the lock wall, and each of said fingers including a locking edge engagable with the lock wall for rotatably securing the journal in the journal receptacle.

20. A portable storage console for holding a plurality of articles as defined in claim 1, wherein the cabinet includes, a bottom having four sides, said bottom having panel grooves formed in each of three sides, a panel mounted in each of the panel grooves, and a top having a panel receiver on each of three sides receiving each of the panels, two of said panels being opposed forming opposite sides of the cabinet, each of said opposed panels having a plurality of tray ledges positioned opposite like tray ledges on the other opposed panel for slideably receiving a tray on each pair of opposed tray ledges, and each of said panels having a plurality of mounting apertures for receiving hooks for holding articles on the panels; each of said trays including a frame, each of said trays having a pair of tongues on opposed sides of the frame for engagement with the cabinet for releasably holding the tray in the cabinet.

21. A portable storage console for holding a plurality of articles as defined in claim 1, wherein the cabinet includes a pair of opposed panels forming opposide sides, each of said panels having a plurality of tray ledges positioned opposite like tray ledges on the other opposite panel for slideably receiving a tray on each pair of opposed tray ledges, each of said panels having a plurality of mounting apertures for receiving hooks for holding articles on the panels, each of said panels having a plurality of lock slots, each of said lock slots being positioned adjacent to a tray ledge, and each of said trays including a frame extending from one side of the cabinet to the other, each of said trays having a pair of tongues on opposite sides of the tray, each of said tongues having a claw, and each claw having a keeper formed integral therewith, each of said keepers being positionable in a lock slot for releasably holding the tray in the cabinet on the respective tray ledges.

22. A portable storage console for holding a plurality of articles as defined in claim 1, wherein said base includes a journal receptacle having its center substantially coincidental with the axis of rotation of the cabinet, a circular track formed integral with the base, said circular track having its center substantially coincidental with the center of the journal receptacle, a track wall formed integral with the side of the base adjacent to the cabinet and being positioned adjacent to the outer periphery of the track, said rollers being rotatably mounted on the track, said cabinet includes a journal formed integral with the lowermost portion of the cabinet, said journal being rotatably mounted in the journal receptacle, said journal including a plurality of cantilever fingers, and each of said fingers including a locking edge engageable with the journal receptacle for rotatably securing the journal in the journal receptacle.

23. A portable storage console for holding a plurality of articles as defined in claim 1, wherein each of said trays includes a frame extending substantially the width of the interior of the cabinet and the length of the interior of the cabinet, a tongue formed integral with one end of one side of the frame, said tongue including a resilient claw, and a keeper formed integral with the claw, said keeper being engagable with the cabinet for releasably holding the tray in a selected portion in the cabinet.

24. A portable storage console for holding a plurality of articles as defined in claim 1, wherein said base is a molded unitary piece having a floor, an outer support edge formed integral with the floor, a journal receptacle formed in the floor having its center substantially coincidental with the axis of rotation of the cabinet, said journal receptacle having an inwardly sloping guide wall having its center substantially coincidental with the axis of rotation of the cabinet, a cylindrical lock wall formed integral with the guide wall and having its center axis substantially coincidental with the center of the guide wall, a journal support formed integral with the floor, a circular track formed integral with the floor for receiving the rollers, said track being circular and having its center substantially coincidental with the center axis of the lock wall, a track wall formed integral with the floor and being adjacent to the outer periphery of the track, an inner track support formed integral with the bottom of the floor and positioned adjacent to the track, and an outer track support formed integral with the bottom of the floor and positioned adjacent to the outer periphery of the track.

25. A portable storage console for holding a plurality of articles as defined in claim 1, including; a base having a journal receptacle, said journal receptacle includes a tapered guide wall having its center coincidental with the axis of rotation of the cabinet, a cylindrical lock wall formed integral with the guide wall and having its center axis coincidental with the center of the guide wall, a circular track formed integral with the base, said circular track having its center substantially coincidental with the axis of the lock wall, a track wall formed integral with the side of the base adjacent to the cabinet and being positioned adjacent to the outer periphery of the track, said rollers being rotatably mounted on the track, said cabinet including a molded plastic unitary bottom having four sides, said bottom having panel grooves formed in each of three sides, a molded plastic unitary panel mounted in each of the panel grooves and two of the panels being opposed, a molded plastic unitary top having a panel receiver on each of three sides receiving each of the panels, a journal formed integral with the bottom of the cabinet adjacent to the base, said journal including a plurality of cantilever fingers rotatably mounted in the lock wall, each of said fingers including a locking edge engagable with the lock wall for rotatably securing the journal in the journal receptacle, each of the opposed panels having a plurality of tray ledges positioned opposite like tray ledges on the other opposed panel for slideably receiving a tray on each pair of opposed tray ledges, each of said panels having a plurality of mounting apertures for receiving hooks for holding articles on the panels; and each of said trays including a frame extending from one side of the cabinet to the other, each of said trays having a pair of opposite tongues, each of said tongues having a claw, and each claw having a keeper formed integral therewith, each of said keepers being positionable in a lock slot for releasably holding the respective trays in their cabinet.

26. A portable storage console for holding a plurality of articles as defined in claim 1, wherein said base is a molded plastic unitary part and includes a journal receptacle, said journal receptacle having its center substantially coincidental with the axis of rotation of the cabinet, said cabinet including a molded plastic unitary bottom, said bottom having a floor, a journal boss formed integral with the floor, a journal formed integral with the boss having its center substantially coincidental with the axis of rotation of the cabinet, said journal having a plurality of cantilever fingers positioned in the journal receptacle of the base, each of said fingers having a locking edge on its free end engagable with the journal receptacle holding the journal in the journal receptacle, a plurality of pairs of roll ears formed integral with the side of the bottom adjacent to the base, said rollers including a roll rotatably mounted in each of the pairs of roll ears and having its axis of rotation substantially intersecting the axis of rotation of the cabinet, said rollers being engagable with the base for supporting the cabinet on the base, said bottom having a pair of panel grooves being parallel to each other, a third panel groove extending between opposed edges of the parallel panel grooves, a molded plastic unitary panel mounted in each of the panel grooves and being substantially perpendicular to the floor, a molded plastic unitary top mounted on the upper edge of the panels, said top including a pair of parallel panel receivers each receiving one of the parallel panels, a third panel receiver extending between the parallel panel receivers having the third panel mounted therein, said top having a stage on its upper surface, each of said panels having a pair of parallel columns along its vertical edges, each panel having a top beam between the upper ends of the columns, each panel having a bottom beam formed integral with the lower edge of the columns, each panel having a plurality of tray ledges substantially perpendicular to the columns and each ledge being in the same plane as the like ledges of the other two panels, a first rail spaced from each of the tray ledges and being positioned adjacent to one of the columns, a second rail spaced from each of the tray ledges and being in the same plane as their respective first rails, an outer plate formed integral with each pair of columns, each outer plate having a plurality of mounting apertures for receiving hooks to support articles on the exterior surface of the console, and a plurality of lock slots formed in each outer plate along one edge.

27. A portable storage console for holding a plurality of articles as defined in claim 1, wherein said base is a molded plastic unitary part and includes a journal receptacle, said journal receptacle having its center substantially coincidental with the axis of rotation of the cabinet, said cabinet including a molded plastic unitary bottom, said bottom having a floor, a journal boss formed integral with the floor, a journal formed integral with the boss having its center substantially coincidental with the axis of rotation of the cabinet, said journal having a plurality of cantilever fingers positioned in the journal receptacle of the base, each of said fingers having a locking edge on its free end engagable with the journal receptacle holding the journal in the journal receptacle, a plurality of pairs of roll ears formed integral with the side of the bottom adjacent to the base, said rollers including a roll rotatably mounted in each of the pairs of roll ears and having its axis of rotation substantially intersecting the axis of rotation of the cabinet, said rollers being engagable with the base for supporting the cabinet on the base, said bottom having a pair of panel grooves being parallel to each other, a third panel groove extending between opposed edges of the parallel panel grooves, a molded plastic unitary panel mounted in each of the panel grooves and being substantially perpendicular to the floor, a molded plastic unitary top mounted on the upper edge of the panels, said top including a pair of parallel panel receivers each receiving one of the parallel panels, a third panel receiver extending between the parallel panel receivers having the third panel mounted therein, said top having a stage on its upper surface, each of said panels having a pair of parallel columns along its vertical edges, each panel having a top beam between the upper ends of the columns, each panel having a bottom beam formed integral with the lower edge of the columns, each panel having a plurality of tray ledges substantially perpendicular to the columns and each ledge being in the same plane as the like ledges of the other two panels, a first rail spaced from each of the tray ledges and being positioned adjacent to one of the columns, a second rail spaced from each of the tray ledges and being in the same plane as their respective first rails, an outer plate formed integral with each pair of columns, each outer plate having a plurality of mounting apertures for receiving hooks to support articles on the exterior surface of the console, and a plurality of lock slots formed in each outer plate along one edge, one of said trays being a unitary molded plastic tray slideably mounted on a pair of tray ledges, said one tray having a substantially flat table extending from one side of the cabinet to the other, said flat table having a substantially smooth uninterrupted surface on one side and a plurality of dividers on the other side, each of said trays having a pair of tongues on opposed sides for engagement with an outer plate for releasably holding the respective tray in the cabinet.

* * * * *